US007731352B2

(12) United States Patent
Yonekawa

(10) Patent No.: US 7,731,352 B2
(45) Date of Patent: Jun. 8, 2010

(54) IMAGE FORMING APPARATUS CAPABLE OF ALLOWING EASY MAINTENANCE

(75) Inventor: Masahiro Yonekawa, Machida (JP)

(73) Assignee: Ricoh Company, Ltd., Tokyo (JP)

( * ) Notice: Subject to any disclaimer, the term of this patent is extended or adjusted under 35 U.S.C. 154(b) by 152 days.

(21) Appl. No.: 11/614,754

(22) Filed: Dec. 21, 2006

(65) Prior Publication Data

US 2007/0140731 A1 Jun. 21, 2007

(30) Foreign Application Priority Data

Dec. 21, 2005 (JP) ..... 2005-367509

(51) Int. Cl.
*B41J 29/13* (2006.01)

(52) U.S. Cl. ..... 347/108

(58) Field of Classification Search ..... 347/108, 347/152, 222, 37; 271/162–164, 171; 399/107, 399/110, 123, 124
See application file for complete search history.

(56) References Cited

U.S. PATENT DOCUMENTS 5,134,443 A * 7/1992 Sumi et al. ..... 399/121
5,915,157 A 6/1999 Takenaka et al.
5,930,561 A 7/1999 Hosokawa et al.
6,057,936 A 5/2000 Obara et al.
6,131,902 A 10/2000 Takenaka et al.
6,507,720 B2 1/2003 Kabumoto et al.
2002/0043910 A1 4/2002 Hashimoto et al.
2003/0210925 A1 * 11/2003 Kida ..... 399/124
2004/0131378 A1 * 7/2004 Hattori et al. ..... 399/90
2007/0139506 A1 * 6/2007 Yonekawa ..... 347/108

FOREIGN PATENT DOCUMENTS

JP 2001-203531 7/2001
JP 2004-004986 1/2004

* cited by examiner

*Primary Examiner*—Stephen D Meier
*Assistant Examiner*—Geoffrey Mruk
(74) *Attorney, Agent, or Firm*—Oblon, Spivak, McClelland, Maier & Neustadt, L.L.P.

(57) ABSTRACT

An image forming apparatus includes a door which is disposed on a rear surface of the image forming apparatus that allows a portion of the rear side thereof to open. The image forming apparatus further includes an image forming unit. The door is disposed at a position accessible to the image forming unit. The door includes a swelling portion which outwardly swells and receives parts and devices therein, for example, cables and tubes of the image forming apparatus. The swelling portion has an arc shape. The door on the rear surface of the image forming apparatus serves as a door for maintenance. The image forming unit includes an inkjet type image forming unit. The image forming unit includes a gel-inkjet type image forming unit.

20 Claims, 6 Drawing Sheets

IMAGE FORMING APPARATUS CAPABLE OF ALLOWING EASY MAINTENANCE

This patent specification is based on and claims priority under 35 U.S.C. §119 from Japanese patent application No. JP2005-367509 filed on Dec. 21, 2005 in the Japanese Patent Office, the entire contents of which are incorporated herein by reference.

BACKGROUND

1. Field of the Invention

The present invention generally relates to an image forming apparatus, and more particularly to an image forming apparatus such as an inkjet recording apparatus which is capable of allowing an easy maintenance of the apparatus.

2. Discussion of the Background

An inkjet recording apparatus which is represented as an inkjet printer, is often used for personal use, when compared with an electrophotographic-type image forming apparatus. Therefore, there are increasing demands for downsizing the main body as well as an occupying space. Thus, various kinds of different structures have been proposed. In addition, a lot of attention has been drawn to the inkjet recording apparatus, because it is considered that the inkjet recording apparatus may replace a conventional electrophotographic-type copier, a printer and so forth.

In light of the above, according to Japanese Patent Laid-Open Application Publications, No. 2004-004986 and No. 2001-203531, structures having a similar exterior as that of an electrophotographic-type copier have been proposed. However, a number of improvements may be necessary.

For example, in related art image forming apparatuses, in order to achieve downsizing of the image forming unit, there may be a problem in which the maintenance operation as well as wiring of cables and tubes are difficult to carry out.

SUMMARY

In view of the foregoing, it is an object of at least one exemplary embodiment of the present invention to provide an image forming apparatus including a maintenance door which is disposed on a rear surface of the image forming apparatus that allows a portion of the rear side thereof to open.

In one exemplary embodiment, a novel image forming apparatus further includes an image forming unit. The maintenance door is disposed at a position accessible to the image forming unit.

In one exemplary embodiment of the above-mentioned image forming apparatus, the maintenance door includes a swelling portion which outwardly swells and receives parts and devices of the image forming apparatus therein.

In one exemplary embodiment of the above-mentioned image forming apparatus, the parts and devices received in the swelling portion include cables and tubes.

In one exemplary embodiment of the above-mentioned image forming apparatus, the swelling portion has an arc shape.

In one exemplary embodiment of the above-mentioned image forming apparatus, the maintenance door on the rear surface of the image forming apparatus serves as a door for maintenance.

In one exemplary embodiment of the above-mentioned image forming apparatus, the image forming unit includes an inkjet type image forming unit. In another exemplary embodiment of the above-mentioned image forming apparatus, the image forming unit includes a gel-inkjet type image forming unit.

BRIEF DESCRIPTION OF THE DRAWINGS

A more complete appreciation of the disclosure and many of the attendant advantages thereof will be readily obtained as the same becomes better understood by reference to the following detailed description of exemplary embodiments when considered in connection with the accompanying drawings, wherein.

DETAILED DESCRIPTION OF EXEMPLARY EMBODIMENTS

Figure 1:
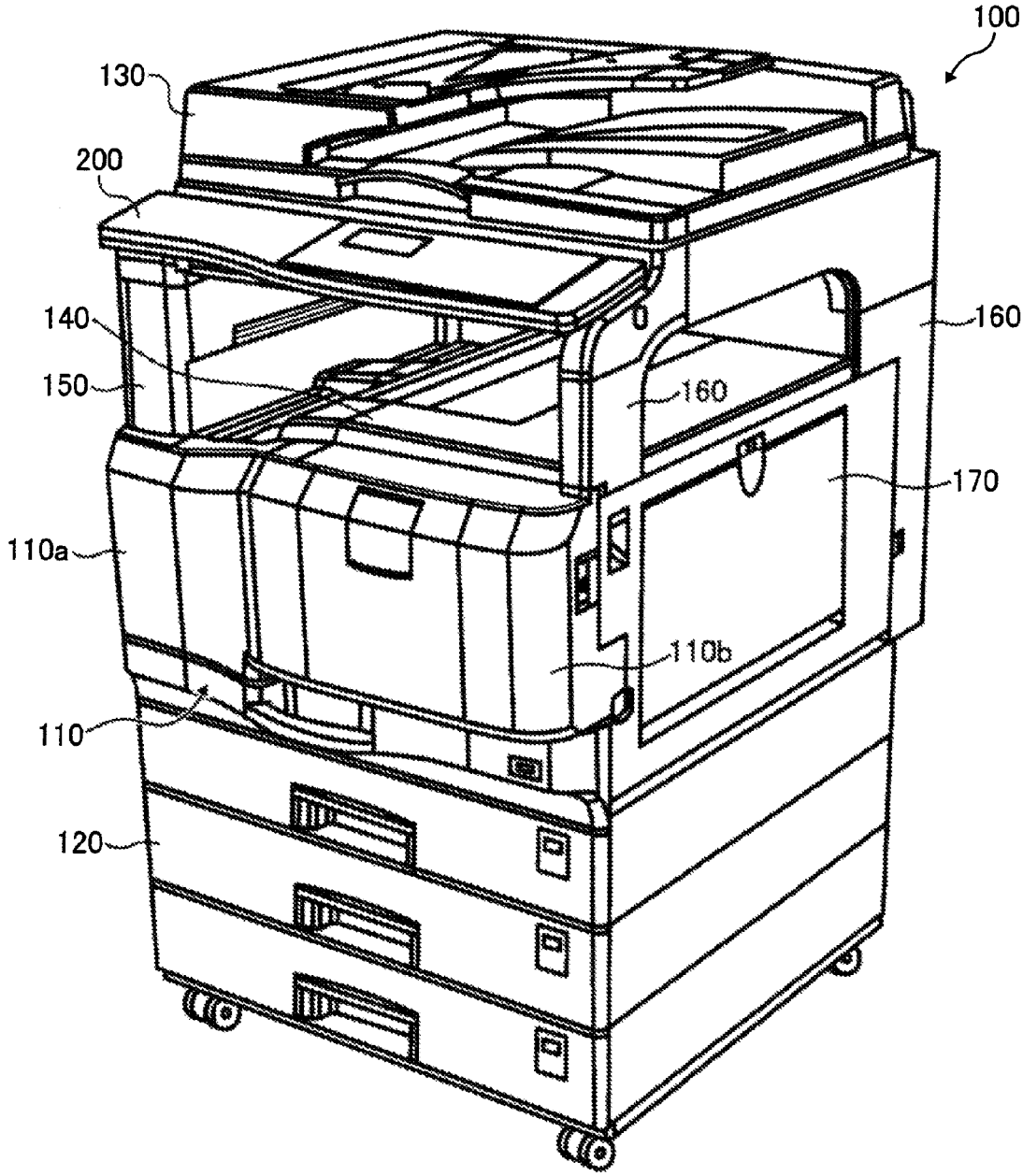
FIG. 1 is a perspective view illustrating an image forming apparatus according to an exemplary embodiment of the present invention.

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. For the sake of simplicity of drawings and descriptions, the same reference numerals are given to materials and constituent parts having the same functions, and descriptions thereof will be omitted unless otherwise stated. Exemplary embodiments of the present invention are now explained below with reference to the accompanying drawings. In later described comparative examples, exemplary embodiments, and alternative examples, the same reference numerals will be given to constituent elements such as parts and materials having the same functions, and the descriptions thereof will be omitted. Referring now to the drawings, wherein like reference numerals designate identical or corresponding parts throughout the several views, particularly to FIG. 1, a structure of an image forming apparatus according to an exemplary embodiment of the present invention is described.

Exemplary embodiments of the present invention will be explained below with reference to drawings. FIG. 1 is a perspective view illustrating an image forming apparatus of an exemplary embodiment of the present invention.

An image forming apparatus 100 shown in FIG. 1 is an image forming apparatus of an internal sheet ejection type using a gel-inkjet. The image forming apparatus 100 includes: an image forming unit 110; a sheet feed unit 120 disposed at a lower portion of the image forming unit 110 and equipped with four sheet feed cassettes; an image reading unit 130 disposed at an upper portion of the image forming unit 110; and a sheet ejecting unit 140 disposed at a position between the image forming unit 110 and the image reading unit 130. A connecting unit 150 is disposed so as to connect the two sides, the left and rear sides of the image forming unit 110 and the image reading unit 130. A connecting unit 160 is disposed so as to connect the right front side of the image forming unit 110 and the image reading unit 130. An operation unit 200 is disposed above the image forming unit 110, that is, at a front upper portion of the image reading unit 130. In FIG. 1, a reference numeral 170 refers to a manual feeding door.

Figure 2:
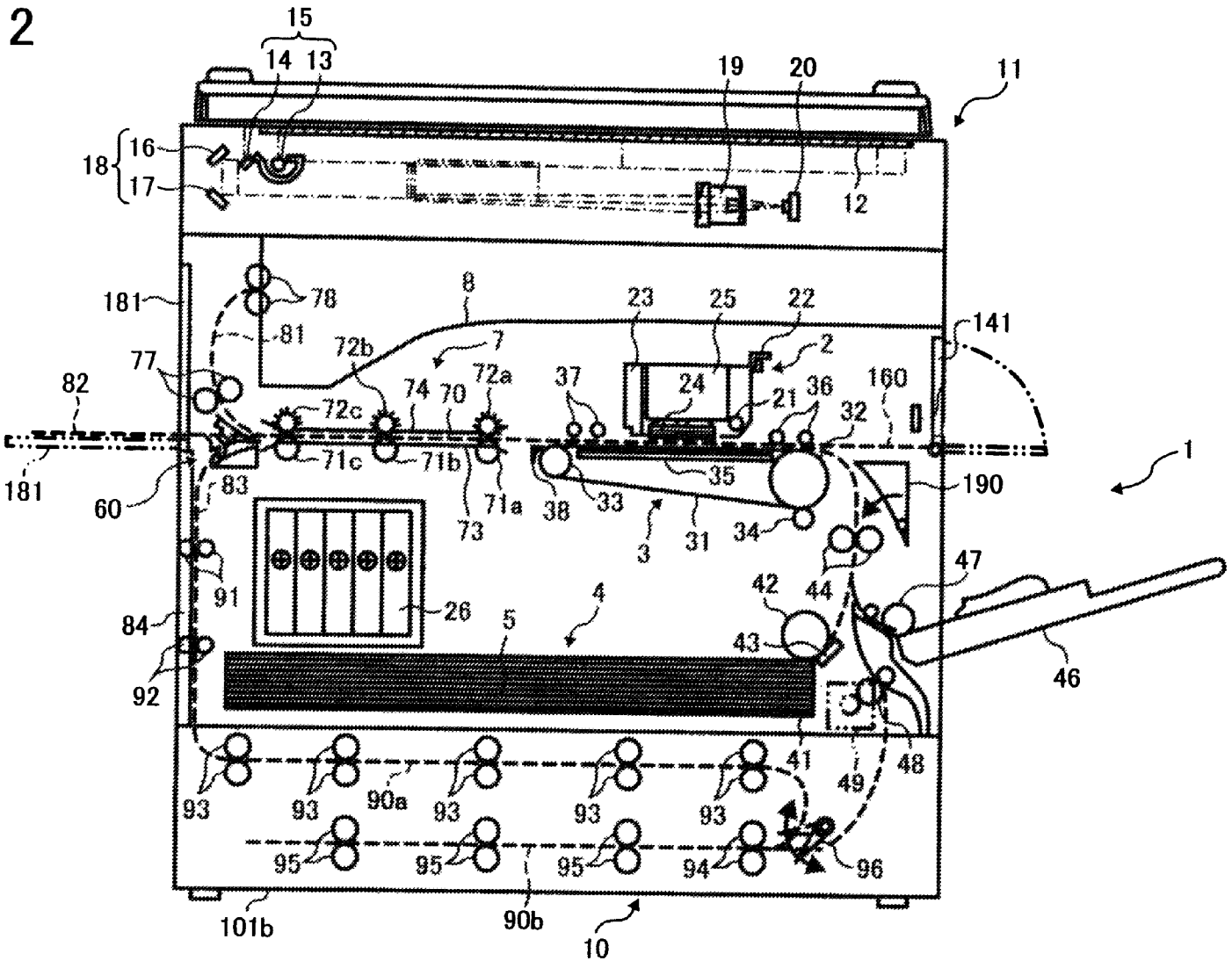
FIG. 2 is a schematic diagram of an image forming unit and an image reading unit of the image forming apparatus of FIG. 1.
Figure 3:
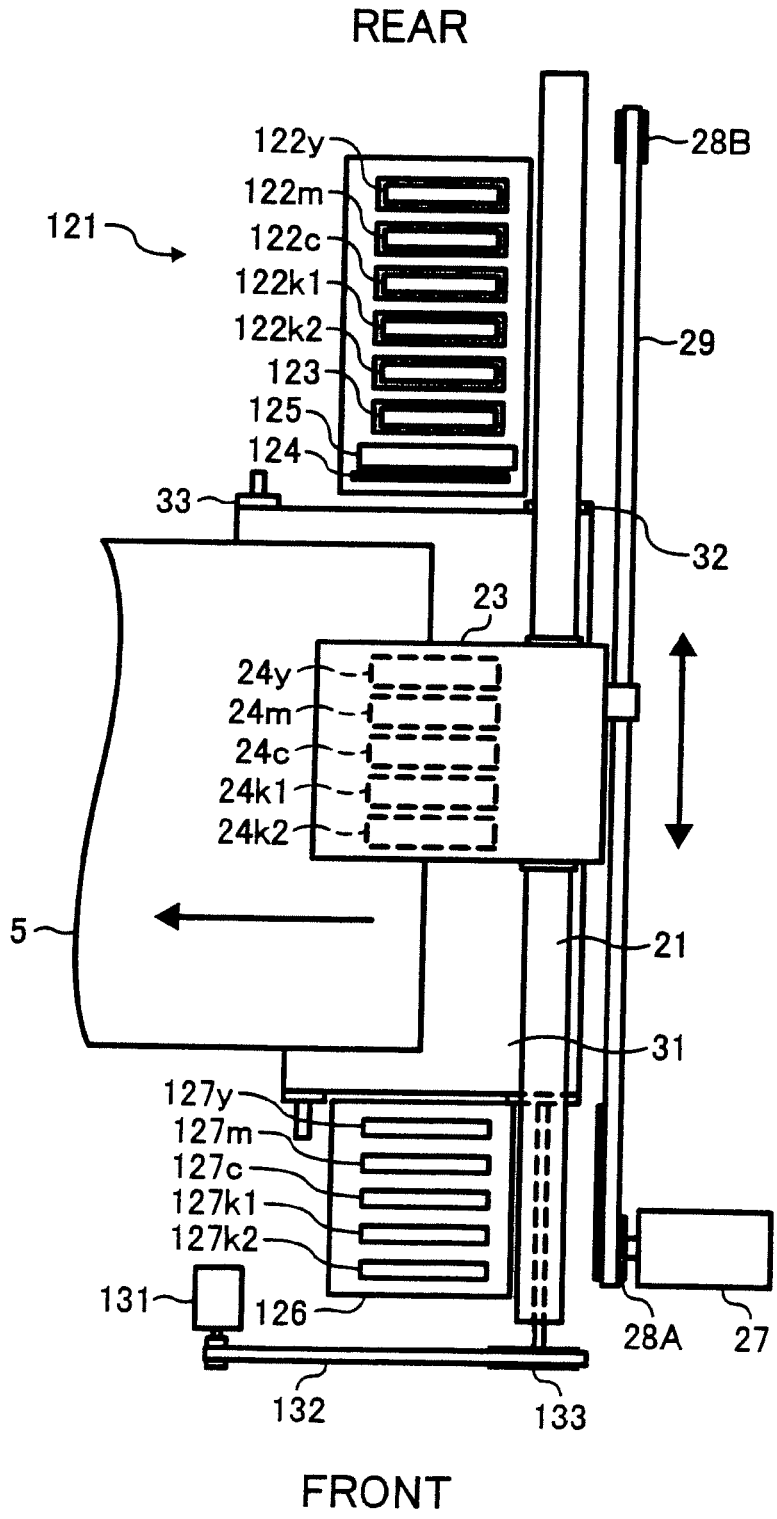
FIG. 3 is a plan view illustrating the image forming unit and a sub-scanning conveyance unit of the image forming apparatus.

FIG. 2 is a schematic diagram illustrating a main body 1 of the image forming apparatus 100 and a mechanical portion of the image reading unit 130. FIG. 3 is a plan view of the image forming unit 110 and a subscanning conveyance unit of the image forming apparatus 100. Referring now to FIG. 2, the main body 1 of the image forming apparatus 100 includes, within a housing of the image forming unit 110, an image forming device 2 for forming an image while transferring a sheet; a subscanning conveyance unit 3 which transfers the sheet; and so forth. A sheet 5 is fed one by one from the sheet feed unit 120 which includes the sheet feed cassettes and is disposed at the bottom of the apparatus main body 1. The subscanning conveyance unit 3 transfers the sheet 5 at a position facing the image forming device 2 while the image forming device 2 ejects liquid droplets on the sheet 5 so as to form or record an image. After the image is formed or recorded, if printing is performed on one side, the sheet 5 is ejected on a catch tray 8 of the sheet ejecting unit 140 formed on the upper portion of the apparatus main body 1 through a ejecting sheet conveyance unit 7. In a case of the duplex printing, the sheet 5 is sent to a duplex unit 10 provided at the bottom of the apparatus main body 1 midway through the ejecting sheet conveyance unit 7 so as to be reversed and re-fed to the subscanning conveyance unit 3. The image is formed on both sides of the sheet 5, and then the sheet 5 is ejected to the catch tray 8.

In the image reading unit 130 for reading an image, disposed above the catch tray 8 at the upper portion of the apparatus main body 1, there is provided a scanner unit 11 as an input system for image data (print data) formed in the image forming device 2. In the scanner unit 11, an optical scan system 15 including a light source 13 and a mirror 14, and an optical scanning system 18 including mirrors 16 and 17 move so as to read an image of a document placed on a contact glass 12. The scanned document image is read as an image signal by an image reading device 20 disposed on the back of the lens 19. The image signal being read is digitalized, and image processing is performed thereon. Subsequently, print data on which the image processing is performed is printed.

Furthermore, the image forming apparatus 100 may receive, as the input system for the image data (print data) formed in the image forming device 2, the print data or the like through a cable or a network. The print data or the like includes image data from a host side such as an information processing apparatus, i.e. an external personal computer; an image reading apparatus, i.e. an image scanner; and an imaging device, i.e. a digital camera. The image forming apparatus 100 may process the received print data to print.

As shown in FIGS. 2 and 3, in the image forming device 2, a guide rod 21 and a guide rail 22 movably hold a carriage 23 in a main scanning direction in a cantilever manner. A main scan motor 27 moves the carriage 23 to scan in the main scanning direction through a timing belt 29 which is laid between a drive pulley 28A and a driven pulley 28B.

On the carriage 23, there are mounted recording heads 24 formed of liquid droplet ejecting heads for ejecting liquid droplets of different colors. A shuttle-type image forming is performed. In the shuttle-type image formation, the carriage 23 is moved in the main scanning direction, and the sheet 5 is transferred in a sheet transfer direction or a sub-scanning direction by the subscanning conveyance unit 3, while liquid droplets are ejected from the recording heads 24. The sheet transfer direction or the sub-scanning direction is indicated by a horizontal arrow in FIG. 3.

The recording heads 24 are formed of two liquid droplet ejecting heads 24*k*1 and 24*k*2 for ejecting black (Bk) ink, and three liquid droplet ejecting heads 24*c*, 24*m* and 24*y*, each ejecting ink of cyan (C), magenta (M) and yellow (Y), respectively. A total of five liquid droplet ejecting heads are provided. Unless otherwise specified, the liquid droplet ejecting heads are hereinafter referred to as the recording heads 24. Each of the sub-tanks 25 (shown in FIG. 2) mounted on the carriage 23 supplies a respective color of ink.

As shown in FIG. 2, ink cartridges 26, which are recording liquid cartridges storing inks of black (Bk), cyan (C), magenta (M) and yellow (Y), are each attachably/detachably mounted to a cartridge mounting portion from the front of the housing 1. The ink cartridges 26 supply each color of ink to the sub-tank 25 of respective colors. The single ink cartridge 26 supplies the black ink to two sub-tanks 25.

Different types of recording heads such as piezoelectric, thermal and electrostatic types may be used for the recording heads 24. The piezoelectric type recording head uses a piezoelectric element as a pressure generating mechanism or an actuator mechanism to press the ink in an ink channel or a pressure generating chamber so as to deform a diaphragm forming a wall of the ink channel. Consequently, the volume of the ink channel changes, thereby ejecting liquid droplets. The thermal type recording head uses a heating element to heat the ink in the ink channel so that a bubble is generated. The pressure caused by the generation of the bubble propels the liquid droplets out. In the electrostatic type recording head, the diaphragm which forms the wall of the ink channel is disposed across from an electrode so that an electrostatic force is generated between the diaphragm and the electrode. Consequently, the diaphragm is deformed, thereby changing the volume of the ink channel and ejecting liquid droplets.

As shown in FIG. 3, a nozzle condition maintenance/recovery mechanism 121, which maintains and recovers the nozzle condition of the recording heads 24, is disposed in a non-print region on one side of the carriage 23 in the scanning direction, that is, a rear side of the apparatus main body 1. The scanning direction or the carriage moving direction is indicated by a front-rear vertical arrow. The nozzle condition maintenance/recovery mechanism 121 includes five moisturizing caps 122*k*1, 122*k*2, 122*c*, 122*m* and 122*y* to cap each of the nozzle surfaces of five recording heads 24. Unless otherwise specified, the moisturizing caps are hereinafter referred to as the moisturizing caps 122. The nozzle condition maintenance/recovery mechanism 121 further includes one suction cap 123, a wiping blade 124 for wiping the nozzle surfaces of the recording heads 24 and a waste droplet receiving member 125 for carrying out ejection or so-called "empty ejection" of liquid droplets which are not used for recording or image formation.

Furthermore, as shown in FIG. 3, a waste droplet receiving member 126 for carrying out ejection or so-called "empty ejection" of liquid droplets, which are not used for recording or image formation from the recording heads 24, is provided in the non-print region on the other side of the carriage 23 in the scanning direction, that is a front side of the apparatus main body 1. Five openings 127*k*1, 127*k*2, 127*c*, 127*m* and 127*y* are formed in the waste droplet receiving member 126, each corresponding to respective recording heads 24. Unless otherwise specified, the openings are hereinafter referred to as the openings 127.

As shown in FIG. 2, the subscanning conveyance unit 3 includes a conveyance roller 32, an endless conveyance belt 31, a charging roller 34, a guide member 35, two pressing rollers or holding rollers 36, two spurs 37 and a separation claw 38. The conveyance roller 32 serving as a drive roller shifts the conveyance direction of the sheet 5 supplied from the downward side by approximately 90 degrees so as to transfer the sheet 5 facing the image forming unit 2. The endless conveyance belt 31 is laid across a driven roller 33 serving as a tension roller. The charging roller 34 is a charging mechanism to which a high voltage (alternating voltage) is applied from a high voltage power source so as to charge the surface of the conveyance belt 31. The guide member 35 guides the conveyance belt 31 in the area opposite to the image forming unit 2. The holding rollers or the pressing rollers 36 press the sheet 5 against the conveyance belt 31 at a position opposite to the conveyance roller 32. The spurs 37 hold an upper surface of the sheet 5 on which an image is formed by the image forming device 2. The separation claw 38 separates the sheet 5, on which the image is formed, from the conveyance belt 31.

The conveyance belt 31 of the subscanning conveyance unit 3 is structured such that when the conveyance roller 32 is rotated through a timing belt 132 and a timing roller 133 by a subscanning motor 131, the conveyance belt 31 rotates in the sheet conveying direction or the subscanning direction shown in FIG. 3. The conveyance belt 31 has, for example, a double layer structure with a front surface layer serving as a sheet suction surface formed of a pure resin material, not applied with resistance control, for example, ETFE pure material, and a rear surface (mid-resistance layer or ground layer) of the same material as that of the front surface layer, but applied with resistance control by carbon. However, the conveyance belt 31 may have a single layer structure or may be formed of three or more layers.

Turning again to FIG. 2, the sheet feed unit 4 is equipped with a sheet feed cassette 41, a sheet feed roller 42, a friction pad 43, and a pair of registration rollers 44. The sheet feed cassette 41 is removably inserted to the apparatus main body 1 from the front and carries a number of sheets 5. The sheet feed roller 42 and the friction pad 43 separate the sheet 5 stored in the sheet feed cassette 41 one by one, and send the sheet 5. The pair of registration rollers 44 register the supplied sheet 5.

Furthermore, the sheet feed unit 4 includes a manual feed tray 46, a manual feed roller 47 and a conveyance roller 48. The manual feed tray 46 carries a number of sheets 5. The manual feed roller 47 separates and feeds the sheet 5 one by one from the manual feed tray 46. The conveyance roller 48 transfers the sheet 5 supplied from an optional sheet feed cassette (not shown) mounted at the bottom of the apparatus main body 1 or from the later-described duplex unit 10. The devices such as the sheet feed roller 42, the registration rollers 44, the manual feed roller 47 and the conveyance roller 48 used for feeding the sheet 5 to the sub-scanning conveyance unit 3 are rotatively driven, through a not-shown magnetic clutch, by a sheet feeding motor or a driving mechanism 49 formed of an HB-type stepping motor.

The ejecting sheet conveyance unit 7 includes three conveyance rollers 71*a*, 71*b* and 71*c*; three spurs 72*a*, 72*b* and 72*c* facing the conveyance rollers 71; a lower guide member 73 and an upper guide member 74; a pair of sheet reversing rollers 77; and a pair of reverse sheet ejecting rollers 78. Unless otherwise specified, the conveyance rollers 71*a*, 71*b* and 71*c* are hereinafter referred to as the conveyance rollers 71. Unless otherwise specified, the spurs 72*a*, 72*b* and 72*c* are hereinafter referred to as the spurs 72. The conveyance rollers 71 conveys the sheet 5 separated by the separation claw 38 of the subscanning conveyance unit 3. The lower guide member 73 and the upper guide member 74 guide the sheet 5 which is carried in a space between the conveyance rollers 71 and the spurs 72. The pair of sheet reversing rollers 77 and a pair of reverse sheet ejecting rollers 78 reverse the sheet 5 transferred from a space between the lower guide member 73 and the upper guide member 74 through a reverse sheet ejecting path 81 serving as a first conveyance path, and eject the sheet 5 in a face-down manner to the catch tray 8. A conveyance path, which conveys the sheet 5 between the lower guide member 73 and the upper guide member 74, is referred to as a conveyance path 70.

At an exit side of the conveyance path 70, there is provided a switching mechanism 60 for switching the sheet conveyance path between the reverse sheet ejecting path or the first sheet ejecting path 81 for ejecting the sheet 5 in a face-down manner to the catch tray 8, a second sheet ejecting path 82 for ejecting the sheet 5 to a later-described linear catch tray 181 and the duplex unit 10.

The duplex unit 10 integrally includes a vertical conveyance unit 84 and a horizontal conveyance unit 101*b*. The vertical conveyance unit 84 forms a vertical duplex conveyance path 83 which receives the sheet 5 being transported from a side portion of the apparatus main body 1 and transfers the sheet 5 in a downward direction. The horizontal conveyance unit 101*b* forms a horizontal intake/conveyance path 90*a* which transfers the sheet 5 in a horizontal direction subsequently to the vertical duplex conveyance path 83, and a switchback transportation path 90*b*.

The vertical duplex conveyance path 83 is provided with a pair of duplex entrance rollers 91 and a pair of conveyance rollers 92. The pair of duplex entrance rollers 91 transfers the sheet 5 in the downward direction. The pair of conveyance rollers 92 transfers the sheet 5 to the horizontal intake/conveyance path 90*a*. The horizontal intake/conveyance path 90*a* is provided with five pairs of duplex conveyance rollers 93. The switchback conveyance path 90*b* is provided with a pair of duplex exit rollers 94 and three pairs of duplex conveyance rollers 95. The pair of duplex exit rollers 94 is formed of reverse rollers which reverse the sheet 5 transferred from the horizontal intake/conveyance path 90*a* so as to re-feed the sheet 5.

Furthermore, a switching plate 96 is swingablly provided so as to switch the conveyance path of the sheet 5 between the path from the horizontal intake/conveyance path 90*a* to the switchback conveyance path 90*b* and the path for re-feeding the sheet 5 from the switchback conveyance path 90*b* to the pair of the conveyance rollers 48. The switching plate 96 is swingable at a position between a switchback position indicated in a solid line and a re-feeding position indicated in a dotted line in FIG. 2.

The sheet 5 fed from the duplex unit 10 is transferred to the above-described conveyance rollers 48 and then to the registration rollers 44.

As shown in FIG. 2, an open/close guide panel 190 is swingablly provided such that when the registration rollers 44 transfer the sheet 5 fed from the sheet feed cassette 41 of the above-described sheet feed unit 4, the manual feed tray 46, and the duplex unit 10, some slack or a loop is formed in the sheet 5 between the conveyance roller 32 and the pressing rollers 36 of the subscanning conveyance unit 3, and the registration rollers 44. Accordingly, back tension against the sheet 5 may be prevented.

When the sheet 5 is transferred from the registration rollers 44 to the subscanning conveyance unit 3, the open/close guide panel 190 swings in a manner shown by an arrow in FIG. 2 so that the sheet 5 is guided. At the time when the sheet 5 reaches the subscanning conveyance unit 3, the open/close guide panel 190 returns to the state shown in FIG. 2 so that some slack or a loop may be formed.

Furthermore, in the image forming apparatus, in order to manually feed a single sheet, as shown in FIG. 2, a single-sheet manual feed tray 141 is provided at one side of the apparatus main body 1, and is openable and closable or may be pulled open relative to the apparatus main body 1. When a single sheet is fed, the single-sheet manual feed tray 141 is pulled open to the position shown by a dash-double dotted line. The sheet 5 manually fed from the single-sheet manual feed tray 141 is guided on the open/close guide panel 190 and may linearly be inserted between the conveyance roller 32 and the pressing roller 36 of the subscanning conveyance unit 3.

Furthermore, in order to linearly eject the sheet 5 on which an image has been formed, in a face-up manner, the linear catch tray 181 is openably and closably provided or may be pulled open at the other side of the apparatus main body 1. When the linear catch tray 181 is opened (pulled open), the second sheet ejecting path 82 for linearly ejecting the sheet 5 transferred from the lower guide member 73 and the upper guide member 74 to the linear catch tray 181 is formed in the sheet ejecting unit 7.

Accordingly, when the sheet 5 having a relatively large thickness, such as an OHP film which may be difficult to curvilinearly transport, is used, the sheet 5 may manually be fed from the single-sheet manual feed tray 141 and may linearly be transferred to the linear catch tray 181. Needless to say, a normal sheet may also be fed from the single-sheet manual feed tray 141 and may linearly be ejected to the linear catch tray 181.

A description will be given of an image forming operation in the image forming apparatus. A high voltage, which is an alternating voltage of positive and negative rectangular waves, is applied to the charging roller 34 from a not-shown AC bias supply unit. Consequently, since the charging roller 34 is in contact with an insulation layer or the front layer of the conveyance belt 31, positive and negative charges are alternately applied in the form of a strip to the front layer of the conveyance belt 31 relative to a conveyance direction of the conveyance belt 31. Accordingly, charging is performed on the surface of the conveyance belt 31 at a predetermined charge band. Thereby, a non-uniform electric field is formed on the conveyance belt 31.

When feeding the sheet 5 from the sheet feed unit 4, the manual sheet feed tray 46, the duplex unit 10, the single-sheet manual feed tray 141, and so forth onto the conveyance belt 31 on which the non-uniform electric field is generated because of the positive and negative charges formed between the conveyance roller 32 and the pressing rollers 36, the sheet 5 is instantly polarized in accordance with the direction of the electric field. Accordingly, the sheet 5 is suctioned onto the conveyance belt 31 and is transferred as the conveyance belt 31 moves.

Subsequently, while the sheet 5 is intermittently transferred by the conveyance belt 31, recording liquid droplets are ejected from the recording heads 24 on the sheet 5 according to the print data so as to form or print an image thereon. The front end of the sheet 5 on which the image is formed is separated from the conveyance belt 31 by the separation claw 38. The ejection sheet conveyance unit 7 ejects the sheet 5 to the catch tray 8 and to the linear catch tray 181 as necessary. Alternatively, the sheet 5 may be transferred to the duplex unit 10 and may be ejected after an image is formed on the other side of the sheet 5.

As shown in FIG. 1, the image forming unit 110 of the image forming apparatus 100 of the exemplary embodiment is configured to be smaller in size than that of a related art image forming apparatus using an electrophotographic method. The door to cover the front side of the apparatus main body 1 is divided into two pieces in a vertical direction: a door 110*a* and a maintenance door 110*b*. The door 110*a* on the left in FIG. 1 is openably and closably mounted to the apparatus main body 1, and the maintenance door 110*b* is mounted to the apparatus main body 1 for the purpose of a maintenance service such that a user may not easily attach or detach the maintenance door 110*b*.

Specifically, the door 110*a* on the left, which is openable/closable by the user, is disposed at a position that allows an easy access to consumables such as ink and toner that need to routinely be replaced. The door 110*a* is mounted to a frame 170 forming the apparatus main body 1 and so forth by hinges or the like so that the door 110*a* may rotatively be opened or closed, and the user may open/close the door 110*a* at ease.

On the other hand, the maintenance door 110*b* for the maintenance service is installed to the apparatus main body 1 such that the user may not easily open or close the maintenance door 110*b*. Specifically, the maintenance door 110*b* is fitted by screws or the like relative to the frame 170 of the apparatus main body 1. The maintenance door 110*b* is disposed at a position that allows the maintenance door 110*b* to cover the front side of an area in which an image forming device (not shown) and so forth of the image forming unit 110 in the apparatus main body 1 are stored. As shown in FIG. 1, the size of the device allocation in the image forming device located at a position corresponding to a position of the maintenance door 110*b* for the maintenance service within the apparatus main body 1 is relatively small. Therefore, it is meaningful that the user may not easily open/close the maintenance door 110*b*.

Figure 4:
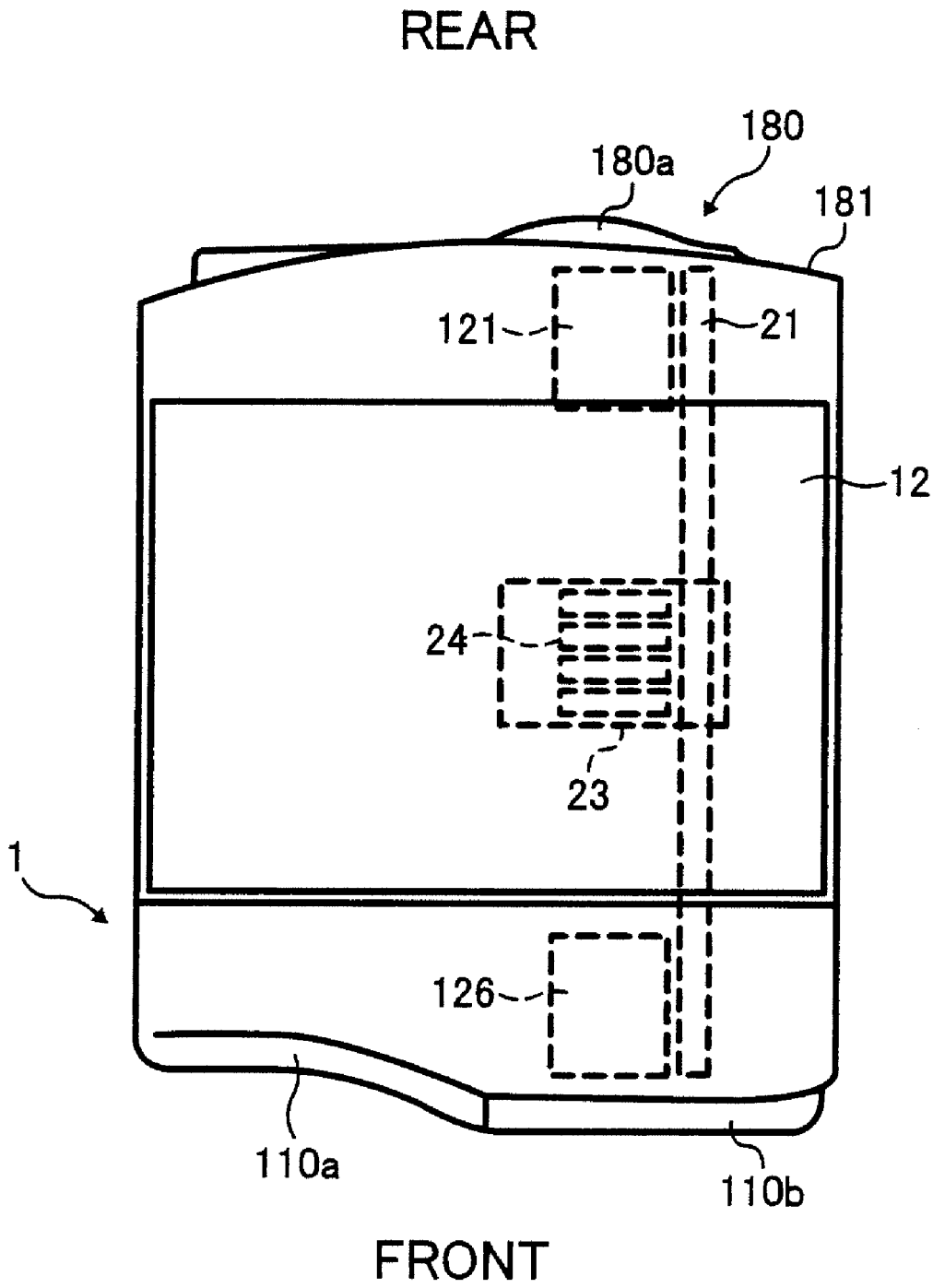
FIG. 4 is a plan view illustrating the image forming apparatus.

As shown in FIG. 4, the door 110*a* for the user and the maintenance door 110*b* for the maintenance service are configured such that the maintenance door 110*b* corresponding to the waste droplet receiving member 126 of the engine unit as shown in FIG. 3, has a shape protruding further toward the front side than the door 110*a*, while the door 110*a* corresponding to an installation position of the ink cartridges 26, has a relatively recessed shape.

As described above, the maintenance/recovery mechanism 121 and the waste droplet receiving member 126 are needed to maintain and recover the recording heads 24 in the image forming unit of the serial scan type. Consequently, a region where the carriage 23 scans is forced to be wider than the sheet passing width. Therefore, in a structure in which the carriage 23 scans in a front and rear directions of the apparatus main body 1, the waste droplet receiving member 126, for example, is disposed at the front.

However, if the shape of the front side is determined according to the external shape of the waste droplet receiving member 126, a wasted space is generated in the area where the ink cartridges 26 (shown in FIG. 2) are installed. Consequently, the size of the apparatus main body 1 increases, thereby increasing an occupying space. Therefore, the apparatus may appear large.

In light of the above, as shown in FIG. 4, the area which does not correspond to the waste droplet receiving member 126 or the maintenance/recovery mechanism 121, that is, the area corresponding to the door 110*a*, has the recessed shape so that the space which the entire apparatus occupies may be reduced in size, and also the depth of the entire apparatus may look more compact. Furthermore, the external shape of the door 110*a* for the user and the maintenance door 110*b* for the maintenance service has a smoothly-curved concavo-convex planar shape as shown in FIG. 4, thereby making the size of the apparatus look even more compact.

In the exemplary embodiments, the waste droplet receiving member 126 which receives liquid droplets which do not contribute to the maintenance/recovery mechanism of the image forming unit and to the image formation is provided at the end portion of the apparatus main body 1 in the front-rear or the vertical direction. However, if the waste droplet receiving member 126 is provided at the end portion of the apparatus main body 1 in the left-right direction or the horizontal direction, either the right side or the left side of the apparatus main body 1 may have a recessed shape.

Figure 5:
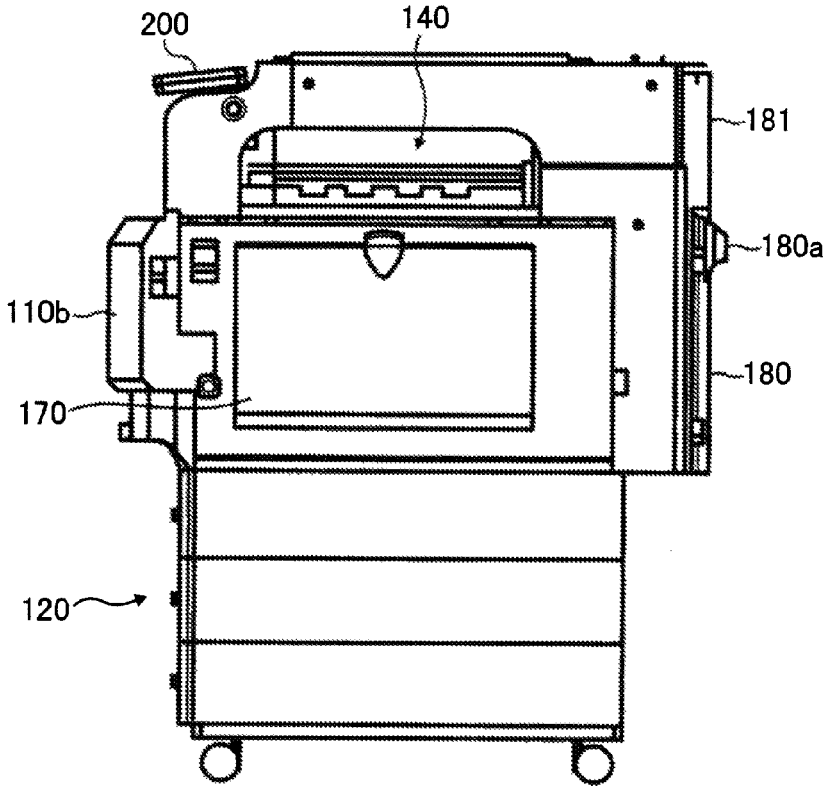
FIG. 5 is a side view illustrating the image forming apparatus.
Figure 6:
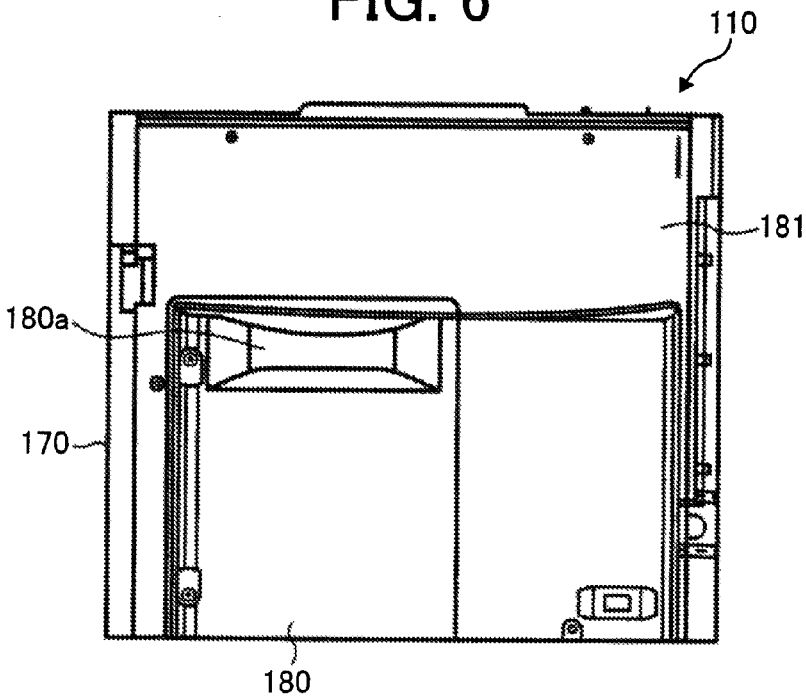
FIG. 6 is a rear view illustrating the image forming apparatus.
Figure 7A:
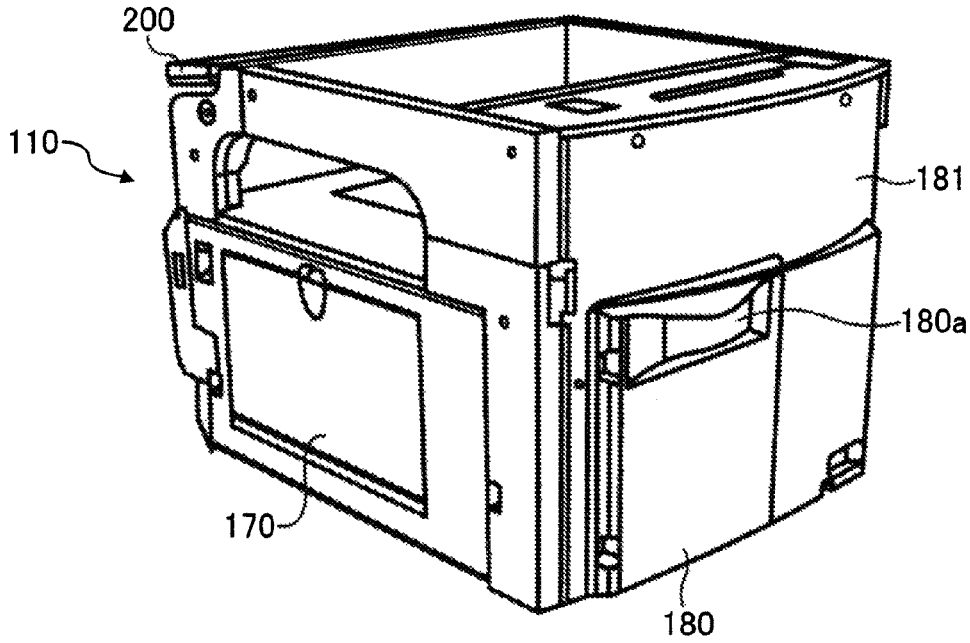
FIG. 7A is a perspective view illustrating the image forming apparatus with a maintenance door in a closed position.
Figure 7B:
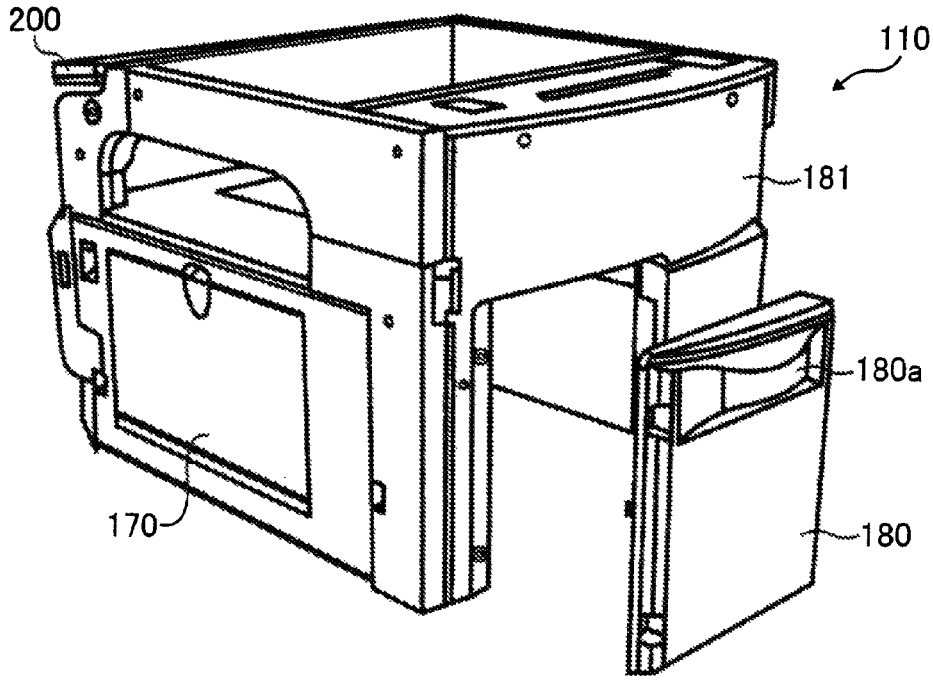
FIG. 7B is a perspective view illustrating the image forming apparatus with the maintenance door in an open position.

FIG. 5 is a side view of an exemplary image forming apparatus of the present invention. FIG. 6 is a rear view of the image forming apparatus shown in FIG. 1. FIG. 7A is a perspective view illustrating the rear surface of the exemplary image forming apparatus of FIG. 1 in a state where the door for the maintenance service is closed. FIG. 7B is a perspective view illustrating the rear surface of the exemplary image forming apparatus of FIG. 1 in a state where the door for the maintenance service is opened.

As shown in FIGS. 7A and 7B, a maintenance door 180 is provided at the rear of the image forming unit 110 at a position near the manual feeding door 170. One side of the maintenance door 180 is fastened by screws while the other side (not shown) is fitted or is attached relative to the apparatus main body 1 by means of other methods. The installation method and configuration are not limited to the method and configuration described above. It is desirable that the maintenance door 180 is installed to the apparatus main body 1 such that the user may not be able to easily open or close the maintenance door 180.

The maintenance door 180 has a swelling shape 180*a* having a substantially flat or mildly outwardly swelling arc shape. However, an area in the vicinity of the upper end portion thereof has a circular shape substantially swelling in an outward direction. The side surface structure of the swelling portion 180*a* has a trapezoidal cross section. One example shape of the swelling portion 180*a* is provided above, and the shape thereof may have a structure other than the above-described shape.

The inside of the swelling portion 180*a* is configured to be hollow so that wires and pipes in the image forming unit 110 may be stored therein, and the tubes for supplying ink may be stored therein when used in an inkjet recording apparatus. In the exemplary embodiments, ink tubes may be folded into a semi-circular shape in the image forming unit 110, and the folded ink tubes protruding toward the rear may be stored in the swelling portion 180*a*. However, the shape of the swelling portion 180*a*, an object to be stored therein, the storage structure and so forth may be modified accordingly.

In the serial-scan type image forming unit 2 shown in FIG. 3, for example, the maintenance/recovery mechanism 121 and the waste droplet receiving member 126 are needed to maintain and recover the recording heads 24 as described above, thereby forcing the scan area of the carriage 23 to be wider than the sheet passing width. Consequently, in a structure in which the carriage 23 scans in a front-rear direction of the apparatus main body 1, the maintenance/recovery mechanism 121, for example, is disposed in the back or at the rear side of the apparatus main body 1. In such a case, if the exterior of the rear side of the apparatus main body 1 has the same shape as that of the maintenance/recovery mechanism 121, the part of the rear side corresponding to the image forming device 2 may protrude. Consequently, the concavity and the convexity of the apparatus main body 1 may become significantly apparent. Furthermore, the maintenance/recovery mechanism 121 becomes relatively larger than the waste droplet receiving member 126. As a result, the concavity and the convexity of the apparatus main body 1 are more enhanced.

In light of the above, in an exemplary embodiment of the present invention, an upper rear surface portion 181 of the apparatus main body 1 of the image forming apparatus 100 is configured to have a curved shape slightly protruding in a backward direction as shown in FIGS. 7A and 7B. The swelling portion 180*a* is formed at a position corresponding to the maintenance/recovery mechanism 121 so that a protruding amount relative to the surface of the maintenance door 181 may become small. Thereby, the unevenness of the rear surface of the apparatus main body 1 due to the maintenance/recovery mechanism 121 of the image forming device 2 may become insignificant.

The above-described exemplary embodiments are applied to the image forming apparatus of an internal sheet ejection type using a gel-inkjet. However, the present invention may not be limited to the image forming apparatus of the internal sheet ejection type. The present invention may also be applied to the image forming apparatus using a general inkjet other than the gel-inkjet.

Embodiments of this invention may be conveniently implemented using a conventional general purpose digital computer programmed according to the teachings of the present specification, as will be apparent to those skilled in the computer art. Appropriate software coding can readily be prepared by skilled programmers based on the teachings of the present disclosure, as will be apparent to those skilled in the software art. Embodiments of the present invention may also be implemented by the preparation of application specific integrated circuits or by interconnecting an appropriate network of conventional component circuits, as will be readily apparent to those skilled in the art.

Any of the aforementioned methods may be embodied in the form of a system or device, including, but not limited to, any of the structure for performing the methodology illustrated in the drawings.

Further, any of the aforementioned methods may be embodied in the form of a program. The program may be stored on a computer readable media and is adapted to perform any one of the aforementioned methods, when run on a computer device (a device including a processor). Thus, the storage medium or computer readable medium is adapted to store information and is adapted to interact with a data processing facility or computer device to perform the method of any of the above mentioned embodiments.

The storage medium may be a built-in medium installed inside a computer device main body or removable medium arranged so that it can be separated from the computer device main body. Examples of the built-in medium include, but are not limited to, rewriteable non-volatile memories, such as ROMs and flash memories, and hard disks. Examples of the removable medium include, but are not limited to, optical storage media such as CD-ROMs and DVDs; magneto-optical storage media, such as MOs; magnetism storage media, such as floppy disks (trademark), cassette tapes, and removable hard disks; media with a built-in rewriteable non-volatile memory, such as memory cards; and media with a built-in ROM, such as ROM cassettes.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An image forming apparatus, comprising:

a door disposed on a rear surface of the image forming apparatus and disposed nearby an end of a maintenance/recovery mechanism of an inkjet image forming unit in the image forming apparatus, wherein a swelling portion of the door corresponding to the end of the maintenance/recovery mechanism protrudes outwardly from the rear surface of the image forming apparatus in a main scanning direction when the door is in a closed position, and the rear surface is adjacent to a side surface of the image forming apparatus through which a sheet is fed to the inkjet image forming unit.

2. The image forming apparatus according to claim 1, wherein the swelling portion of the door is hollow and configured to receive parts and devices of the image forming apparatus therein.

3. The image forming apparatus according to claim 2, wherein the parts and devices received in the swelling portion include cables and tubes.

4. The image forming apparatus according to claim 2, wherein the swelling portion has an arc shape.

5. The image forming apparatus according to claim 1, wherein the door on the rear surface of the image forming apparatus serves as a door for maintenance.

6. The image forming apparatus according to claim 1, wherein the inkjet image forming unit includes a gel-inkjet type image forming unit.

7. The image forming apparatus according to claim 1, wherein the door is attached to the image forming unit via screws.

8. The image forming apparatus according to claim 1, further comprising:

an access door disposed on a front surface of the image forming apparatus configured to allow consumables to be refilled.

9. The image forming apparatus according to claim 8, wherein the access door has a recessed shape.

10. The image forming apparatus according to claim 1, wherein the swelling portion of the door corresponding to the end of the maintenance/recovery mechanism protrudes further outwardly from the rear surface in a scanning direction than an outermost portion of the door not corresponding to the end of the maintenance/recovery mechanism.

11. The image forming apparatus according to claim 1, wherein the end of the maintenance/recovery mechanism is positioned outside of a print region in a direction substantially perpendicular to a sheet transfer direction.

12. An image forming apparatus, comprising:

an entrance means disposed on a rear surface of the image forming apparatus and disposed nearby an end of a maintenance/recovery mechanism of an inkjet image forming unit in the image forming apparatus, wherein a swelling portion of the entrance means corresponding to the end of the maintenance/recovery mechanism protrudes outwardly from the rear surface of the image forming apparatus in a main scanning direction when the entrance means is in a closed position, and the rear surface is adjacent to a side surface of the image forming apparatus through which a sheet is fed to the inkjet image forming unit.

13. The image forming apparatus according to claim 12, wherein the swelling portion of the entrance means corresponding to the end of the maintenance/recovery mechanism protrudes further outwardly from the rear surface in a scanning direction than an outermost portion of the entrance means not corresponding to the end of the maintenance/recovery mechanism.

14. The image forming apparatus according to claim 12, wherein the end of the maintenance/recovery mechanism is positioned outside of a print region in a direction substantially perpendicular to a sheet transfer direction.

15. An image forming apparatus, comprising:

a first door which is disposed on a rear surface of the image forming apparatus and disposed at a position corresponding to an end of a maintenance/recovery mechanism of an inkjet image forming unit in the image forming apparatus, wherein a swelling portion of the first door corresponding to the end of the maintenance/recovery mechanism protrudes outwardly from the rear surface of the image forming apparatus in a main scanning direction when the door is in a closed position; and a second door positioned on a side surface adjacent to the rear surface, and the second door is a manual feed door through which a sheet is fed to the inkjet image forming unit in a sheet transfer direction.

16. The image forming apparatus according to claim 15, wherein the maintenance/recovery mechanism is on a same side of the image forming apparatus as the first door.

17. The image forming apparatus according to claim 15, wherein the maintenance/recovery mechanism is accessible via the first door.

18. The image forming apparatus according to claim 15, wherein the swelling portion of the first door corresponding to the end of the maintenance/recovery mechanism protrudes further outwardly from the rear surface in a scanning direction than an outermost portion of the first door not corresponding to the end of the maintenance/recovery mechanism.

19. The image forming apparatus according to claim 15, wherein the end of the maintenance/recovery mechanism is positioned outside of a print region in a direction substantially perpendicular to the sheet transfer direction.

20. The image forming apparatus according to claim 15, further comprising:

a third door and a fourth door attached to a front surface of the image forming apparatus to vertically divide the front side of the image forming apparatus such that the first door and the second door do not overlap in a vertical direction, the front surface being positioned across from the rear surface and adjacent to the side surface, the third door being recessed into the image forming apparatus such that the fourth door extends outwardly from the image forming apparatus further than the third door, and an end of a waste droplet receiving member of the inkjet image forming unit is concealed by the fourth door and extends outwardly from the main unit further than a portion of an outer face of the third door.

* * * * *